US012163420B2

(12) United States Patent
Frith et al.

(10) Patent No.: US 12,163,420 B2
(45) Date of Patent: Dec. 10, 2024

(54) ACOUSTIC DATALINK WITH SHOCK ABSORBING TOOL USEFUL IN DOWNHOLE APPLICATIONS

(71) Applicant: Gordon Technologies LLC, Scott, LA (US)

(72) Inventors: Benjamin G. Frith, Lafayette, LA (US); Terrence G. Frith, Lafayette, LA (US); J. Hunter Simmons, Lafayette, LA (US)

(73) Assignee: Gordon Technologies, LLC, Scott, LA (US)

( * ) Notice: Subject to any disclaimer, the term of this patent is extended or adjusted under 35 U.S.C. 154(b) by 55 days.

(21) Appl. No.: 18/296,810

(22) Filed: Apr. 6, 2023

(65) Prior Publication Data

US 2023/0349287 A1 Nov. 2, 2023

Related U.S. Application Data

(63) Continuation-in-part of application No. 17/495,429, filed on Oct. 6, 2021, now abandoned.
(Continued)

(51) Int. Cl.
*E21B 47/18* (2012.01)
*E21B 47/14* (2006.01)
*E21B 47/16* (2006.01)

(52) U.S. Cl.
CPC ..... *E21B 47/18* (2013.01); *E21B 47/14* (2013.01); *E21B 47/16* (2013.01)

(58) Field of Classification Search
CPC ..... E21B 47/12; E21B 47/14; E21B 47/16; E21B 47/18; E21B 47/20; E21B 47/22; E21B 47/24
See application file for complete search history.

(56) References Cited

U.S. PATENT DOCUMENTS 4,265,305 A * 5/1981 Stone ..... E21B 23/14 73/431
5,373,481 A * 12/1994 Orban ..... E21B 47/16 340/854.4

(Continued)

FOREIGN PATENT DOCUMENTS

WO 2020/154399 A1 7/2020

OTHER PUBLICATIONS

Baker Hughes, "XACT acoustic system monitored real-time fluid levels to reduce TCP risk, minimize rig impact", publication copyright 2020.

(Continued)

*Primary Examiner* — Franklin D Balseca
(74) *Attorney, Agent, or Firm* — Zeman-Mullen & Ford, LLP

(57) ABSTRACT

Telemetry of data from a Remote Data Source (RDS) in a Bottom Hole Assembly (BHA) for subterranean drilling. The BHA has a Bottom Mounted Mud Pulser (BMMP), a Main Processing Unit (MPU) and an acoustic sensor uphole from the BMMP, a shock absorbing tool downhole from the BMMP, and the RDS downhole from the shock absorbing tool. A first encoded RDS data signal is translated into an acoustic data signal, which follows an acoustic pathway to the acoustic sensor. An acoustic contact assembly sleeve preferably deployed uphole from the shock absorbing tool allows the acoustic data signal to bypass the shock absorbing tool. The acoustic sensor translates the acoustic data signal into a second encoded RDS data signal. The MPU decodes the second encoded RDS data signal into RDS data. The BMMP telemeters the RDS data received from the MPU in at least an uphole direction.

20 Claims, 11 Drawing Sheets

Related U.S. Application Data

(60) Provisional application No. 63/327,969, filed on Apr. 6, 2022, provisional application No. 63/088,309, filed on Oct. 6, 2020.

(56) References Cited

U.S. PATENT DOCUMENTS

| | | | |
|---|---|---|---|
| 5,924,499 | A | 7/1999 | Birchak et al. |
| 9,523,272 | B2 | 12/2016 | McMillon et al. |
| 9,644,434 | B2 * | 5/2017 | Frith ..... E21B 17/07 |
| 10,364,668 | B2 | 7/2019 | Park et al. |
| 10,386,318 | B2 | 8/2019 | Hay et al. |
| 2004/0145970 | A1 | 7/2004 | Dopf et al. |
| 2007/0257809 | A1 | 11/2007 | Camwell et al. |
| 2008/0253228 | A1 | 10/2008 | Camwell et al. |
| 2010/0157741 | A1 | 6/2010 | Drumheller et al. |
| 2011/0214920 | A1 | 9/2011 | Vail, III et al. |
| 2011/0247878 | A1 | 10/2011 | Rasheed |
| 2013/0038464 | A1 | 2/2013 | Alteirac et al. |
| 2014/0011466 | A1 | 1/2014 | Moore et al. |

OTHER PUBLICATIONS

Baker Hughes, "XACT bi-directional acoustic telemetry service", publication copyright 2021.

International Search Report and the Written Opinion of the International Searching Authority issued in related application No. PCT/US2021/053800 mailed Dec. 29, 2021 (13 pages).

Gutierrez-Estevez et al., "Acoustic Channel Model for Adaptive Downhole Communication over Deep Drill Strings", IEEE, 2013, retrieved on [Dec. 11, 2021]. Retrieved from the internet <URL: https://ieeexplore.ieee.org/stamp/stamp.jsp?tp=&arnumber=6638589>.

* cited by examiner 200
201
202
212
DOWNHOLE
UPHOLE 204
216
213
203
215

ACOUSTIC DATALINK WITH SHOCK ABSORBING TOOL USEFUL IN DOWNHOLE APPLICATIONS

RELATED APPLICATIONS AND PRIORITY CLAIM

This application claims the benefit of, and priority to, and commonly-owned U.S. Provisional Patent Application Ser. No. 63/327,969 filed Apr. 6, 2022. This application is also a continuation-in-part of and commonly-owned U.S. Nonprovisional patent application Ser. No. 17/495,429 filed Oct. 6, 2021. Ser. No. 17/495,429 claims the benefit of, and priority to, commonly-owned U.S. Provisional Patent Application Ser. No. 63/088,309 filed Oct. 6, 2020. The entire disclosures of 63/327,969, Ser. No. 17/495,429 and 63/088,309 are incorporated herein by reference as if fully set forth herein.

FIELD OF THE DISCLOSURE

This disclosure is directed generally to subterranean drilling technology, and more specifically to acoustic datalink technology, allowing near-bit tools, sensors, etc. to communicate with the surface via existing mud pulse telemetry equipment conventionally deployed further uphole.

BACKGROUND OF THE DISCLOSED TECHNOLOGY

In a downhole drilling environment with a bottom hole assembly (BHA) that includes an Measurement While Drilling (MWD) system telemetering to the surface via a bottom-mounted mud pulser, it is sometimes desirable to place additional electronic components below the pulser for, just for example, data-gathering and/or steering purposes. One example of a data-gathering component would be a Dynamics While Drilling or Diagnostics While Drilling (DWD) tool that monitors drill string torque, annular pressure, etc. An example of a steering component would be a Rotary Steerable System (RSS) that is used to steer the drill bit in a deviated portion of the wellbore. In such cases, it is beneficial to establish data transmission between the MWD tool processing unit (MPU) located uphole from the pulser and the Remote Data Sources (RDS) located downhole from the pulser, since the MWD MPU has the ability to send data to the surface via telemetry being monitored by drilling personnel. The personnel can then use the additional RDS information to make adjustments to drilling parameters, resulting in benefits such as in faster rates of progress and/or reductions in damage to drillstring components.

Current MWD systems are preferably retrievable, meaning they are preferably located near the uphole end of the BHA so that they can be retrieved (via fishing operations, for example) if the BHA becomes stuck further downhole or even lost in hole. The MWD system's mud pulser (advantageously, a servo-driven mud pulser) is usually located a short distance downhole from the MWD system itself. In this way, the pulser can telemeter MWD data robustly and accurately to the surface while still also being retrievable. Often the mud pulser is located just uphole from the Universal Bottom Hole Orientation (UBHO) sub since the UBHO sub is rarely retrievable. In such deployments, the MWD system including the mud pulser are retrievable. However, as noted in the previous paragraph, remote data sources (RDS) such as DWD or RSS have to be near the bit to be effective, and so are necessarily located downhole from the MWD system and the UBHO sub. A "shorthop" datalink thus has to be established between the RDS and the MWD system so that the MWD MPU may send RDS data as well as MWD data to the mud pulser for telemetry to the surface.

Electromagnetic (EM) shorthop technology is currently available to transfer RDS data uphole for further telemetering to the surface. EM shorthop technology calls for RDS data to be modulated onto an EM signal generated by a transmitter located nearby. The broadcast EM signal passes through the downhole formation, and is received at another point in the drillstring. This technology is known to be used to allow remote data sources to communicate with MWD systems further uphole. The distance capability of this data transmission is in the range of 10 to 80 feet. However, there are performance issues that plague EM shorthops. First, EM transmission tends to consume considerable electrical power. Downhole electrical power is generally provided by batteries, and so is typically a finite resource. Shortened battery life will result in a less time spent drilling in between trips to the surface to replace the spent battery. Second, the distance over which the EM signal can be robustly transmitted is highly dependent on the composition of the downhole formation that is being bored. Some formations, such as salt, tend to attenuate an EM signal substantially. Other formations require complex calculations to determine optimal spacing between the transmitter and receiver, along with the necessary power requirements for signal generation. Third, current antenna technology used for transmitting the EM signal is prone to shorting out and causing a failure in data transmission. Fourth, most EM shorthop systems call for an antenna to be placed inside the drillstring for better protection against the drilling environment. This interior antenna deployment requires that a non-metallic "window" be placed in the drillstring collar to allow the EM signal to pass through the collar and into the formation. This window creates a weak point in the drillstring that is subject to mechanical failure if drilling parameters such as weight-on-bit, build rate, or torque are allowed to get too high.

There is therefore a need in the art for an alternative to EM shorthop technology for establishing RDS data communication uphole to, for example, an MWD system and mud pulser for further telemetry to the surface.

SUMMARY AND TECHNICAL ADVANTAGES

The needs in the art described above in the "Background" section are addressed by an acoustic shorthop datalink that establishes wireless data transmission between remote data sources (RDS) near the bit and, for example, an MWD telemetry system further uphole. The acoustic shorthop datalink is an advantageous alternative to existing EM shorthops serving the same purpose, whose disadvantages are described above in the "Background" section. The acoustic datalink technology disclosed herein allows a conventional retrievable MWD system and retrievable mud pulser to be used to telemeter RDS data to the surface along with MWD data. In preferred embodiments, the acoustic datalink provides components enabling an acoustic signal pathway along a desired portion of the drillstring. The acoustic pathway may run both inside and along the drillstring collar, per user design. An inventive method arises in which an electrical data signal is received from the RDS, which, once encoded, is translated into a corresponding acoustic RDS data signal. The acoustic RDS data signal travels the acoustic pathway uphole over or through various components, advantageously including the UBHO sub, until the acoustic RDS data signal reaches an acoustic sensor. In embodiments in which the BHA further includes a shock absorbing tool, an acoustic contact assembly sleeve is preferably deployed uphole from the shock absorbing tool and also preferably deployed downhole from the BMMP. The acoustic contact assembly sleeve may allow the acoustic RDS data signal to bypass the shock absorbing tool as the acoustic RDS data signal follows the acoustic pathway. Once the acoustic RDS data signal reaches the acoustic sensor, the acoustic sensor translates the acoustic RDS data signal back into a corresponding electrical RDS data signal. The electrical RDS data signal is still encoded. After decoding, the decoded RDS data is passed to the MWD MPU. The MWD MPU sends the RDS data to the mud pulser for telemetry to the surface.

According to a first aspect, therefore, this disclosure describes embodiments of a method for telemetering data from a Remote Data Source (RDS) in a Bottom Hole Assembly (BHA) for subterranean drilling oriented such that downhole is towards a drill bit and uphole is away from the drill bit, the method comprising steps of: (a) providing a Bottom Mounted Mud Pulser (BMMP) in the BHA; (b) providing a Main Processing Unit (MPU) and an acoustic sensor uphole in the BHA from the BMMP; (c) providing a shock absorbing tool downhole in the BHA from the BMMP and the RDS downhole in the BHA from the shock absorbing tool, wherein the RDS is configured to generate RDS data; (d) encoding the RDS data into a corresponding first encoded RDS data signal; (e) translating the first encoded RDS data signal into a corresponding acoustic RDS data signal; (f) causing the acoustic RDS data signal to follow an acoustic pathway to the acoustic sensor, wherein an acoustic contact assembly sleeve allows the acoustic RDS data signal to bypass the shock absorbing tool as the acoustic RDS data signal follows the acoustic pathway; (g) causing the acoustic sensor to translate the acoustic RDS data signal into a second encoded RDS data signal; (h) causing the MPU to decode the second encoded RDS data signal into RDS data and send said decoded RDS data to the BMMP; and (i) causing the BMMP to telemeter RDS data received from the MPU in at least an uphole direction.

According to a second aspect, this disclosure describes a method for telemetering data from a Remote Data Source (RDS) in a Bottom Hole Assembly (BHA) for subterranean drilling oriented such that downhole is towards a drill bit and uphole is away from the drill bit, the method comprising steps of: (a) providing a Bottom Mounted Mud Pulser (BMMP) in the BHA; (b) providing a Main Processing Unit (MPU) and an acoustic sensor uphole in the BHA from the BMMP; (c) providing a shock absorbing tool downhole in the BHA from the BMMP and the RDS downhole in the BHA from the shock absorbing tool, wherein the RDS is configured to generate RDS data at the RDS; (d) providing a piezoelectric translator downhole in the BHA from the BMMP; (e) encoding the RDS data into a corresponding first encoded RDS data signal; (f) causing the piezoelectric translator to translate the first encoded RDS data signal into a corresponding acoustic RDS data signal; (g) causing the acoustic RDS data signal to follow an acoustic pathway to the acoustic sensor, wherein an acoustic contact assembly sleeve allows the acoustic RDS data signal to bypass the shock absorbing tool as the acoustic RDS data signal follows the acoustic pathway; (h) causing the acoustic sensor to translate the acoustic RDS data signal into a second encoded RDS data signal; (i) causing the MPU to decode the second encoded RDS data signal into RDS data and send said decoded RDS data to the BMMP; and (j) causing the BMMP to telemeter RDS data received from the MPU, wherein said telemetry by the BMMP is in at least an uphole direction.

Embodiments according to the first or second aspects may provide that selected ones of the MPU and the BMMP are retrievable.

Embodiments according to the first or second aspects may provide that the first and second encoded RDS data signals are substantially the same.

Embodiments according to the first aspect may provide that the RDS is configured to generate RDS data at the RDS.

Embodiments according to the first aspect may provide that step (e) is performed downhole in the BHA from the RDS.

Embodiments according to the first or second aspects may provide that the RDS is selected from at least one of a group consisting of: (1) a Diagnostics While Drilling tool; (2) a Logging While Drilling tool; (3) a Measurement While Drilling tool; (4) a Dynamics While Drilling tool; (5) a Rotary Steerable System; and (6) a smart motor.

Embodiments according to the first aspect may provide that step (e) includes amplifying the acoustic RDS data signal.

Embodiments according to the second aspect may provide that the piezoelectric translator is positioned downhole in the BHA from the RDS.

Embodiments according to the first or second aspects may provide that the acoustic contact assembly sleeve is deployed uphole in the BHA from the shock absorbing tool.

According to a third aspect, this disclosure describes a Bottom Hole Assembly (BHA) for subterranean drilling oriented such that downhole is towards a drill bit and uphole is away from the drill bit, the BHA comprising: a Bottom Mounted Mud Pulser (BMMP); a Main Processing Unit (MPU) positioned uphole from the BMMP; an acoustic sensor positioned uphole from the BMMP; a shock absorbing tool positioned downhole from the BMMP; a Remote Data Source (RDS) positioned downhole from the shock absorbing tool, wherein the RDS is configured to generate RDS data; a piezoelectric translator positioned downhole from the BMMP, wherein the piezoelectric translator is configured to translate a first encoded RDS data signal into a corresponding acoustic RDS data signal; and an acoustic pathway traveling from the piezoelectric translator to the acoustic sensor; wherein the acoustic pathway is configured to carry the acoustic RDS data signal to the acoustic sensor, wherein an acoustic contact assembly sleeve allows the acoustic RDS data signal to bypass the shock absorbing tool as the acoustic RDS data signal follows the acoustic pathway; wherein the acoustic sensor is configured to translate the acoustic RDS data signal into a second encoded RDS data signal; wherein the MPU is configured to decode the second encoded RDS data signal into RDS data and send said decoded RDS data to the BMMP; and wherein the BMMP is configured to telemeter RDS data received from the MPU in at least an uphole direction.

Embodiments according to the third aspect may provide that selected ones of the MPU and the BMMP are retrievable.

Embodiments according to the third aspect may provide that the first and second encoded RDS data signals are substantially the same.

Embodiments according to the third aspect may provide that the piezoelectric translator is positioned downhole from the RDS.

Embodiments according to the third aspect may provide that the RDS is configured to generate RDS data at the RDS.

Embodiments according to the third aspect may provide that the RDS is selected from at least one of a group consisting of: (1) a Diagnostics While Drilling tool; (2) a Logging While Drilling tool; (3) a Measurement While Drilling tool; (4) a Dynamics While Drilling tool; (5) a Rotary Steerable System; and (6) a smart motor.

Embodiments according to the third aspect may provide that the acoustic contact assembly sleeve is deployed uphole from the shock absorbing tool.

It is therefore a technical advantage of the disclosed acoustic shorthop datalink to avoid drawbacks of conventional EM shorthop technology (as described above in the "Background" section). In preferred embodiments, the acoustic RDS data signal comprises high frequency vibrations travelling through the drillstring tubulars. Robust acoustic signal transmission is thus not dependent on surrounding wellbore composition, but instead on maintaining a continuous line of effective physical contact (and preferably metallic contact) from the acoustic signal transmitter to the receiver. Since drillstring components are typically, if not always, metallic, RDS data transmission according to this disclosure will be more reliable and predictable. Further, the acoustic datalink described in this disclosure obviates the need for a "window" in the drillstring collar as often required by EM shorthops. The structure integrity of drillstring collars near the bit is thus preserved. Yet further, the acoustic datalink described in this disclosure obviates the need for a fault-prone EM antenna and associated complex positional calculations.

A further technical advantage of the disclosed acoustic datalink technology is that it enables conventional and existing mud pulse telemetry to communicate RDS data with the surface.

In some embodiments, the acoustic datalink technology described in this disclosure may be characterized to work with a shock-absorbing UBHO/pulser sub, also referred to herein as a shock absorbing tool. The "Shock Miser®" tool described in U.S. Pat. No. 9,644,434 is one non-limiting example of a shock absorbing tool with which the acoustic datalink technology disclosed herein may be characterized to work. An advantage provided by a shock absorbing tool (such as the Shock Miser® tool described in the '434 patent) is to dampen the mud pulser's transmitter valve from environmental vibration or shock forces from drilling operations. As a result, among other benefits, the shock absorbing tool enables the mud pulser to deliver a cleaner train of acoustic mud pulses in which background environmental acoustic noise has been attenuated.

Turning now to the acoustic datalink methodology described in this disclosure, creating an acoustic datalink pathway across a shock absorbing tool presents an additional challenge. As noted, a shock absorbing tool provides features to dampen the mud pulser's transmitter valve from environmental vibration or shock forces. The acoustic datalink pathway has to avoid these dampening features on the shock absorbing tool in order not to inadvertently also dampen and attenuate an acoustic RDS data signal traveling along the acoustic datalink pathway. The acoustic datalink methodology described in this disclosure may be characterized so that the acoustic datalink pathway may avoid dampening features on a shock absorbing tool when a shock absorbing tool is present.

The foregoing has rather broadly outlined some features and technical advantages of the disclosed acoustic datalink technology, in order that the following detailed description may be better understood. Additional features and advantages of the disclosed technology may be described. It should be appreciated by those skilled in the art that the conception and the specific embodiments disclosed may be readily utilized as a basis for modifying or designing other structures for carrying out the same inventive purposes of the disclosed technology, and that these equivalent constructions do not depart from the spirit and scope of the technology as described.

BRIEF DESCRIPTION OF THE DRAWINGS

For a more complete understanding of the embodiments described in this disclosure, and their advantages, reference is made to the following detailed description taken in conjunction with the accompanying drawings, in which.

DETAILED DESCRIPTION

Reference is now made to FIGS. 1 through 10A in describing the currently preferred embodiments of the disclosed acoustic short hop technology, and its related features. FIGS. 1 through 10A should be viewed as a whole for the purposes of the following disclosure. Any part, item, or feature that is identified by part number on one of FIGS. 1 through 10A will have the same part number when illustrated on another of FIGS. 1 through 10A. It will be understood that the embodiments as illustrated and described with respect to FIGS. 1 through 10A are exemplary, and the scope of the inventive material set forth in this disclosure is not limited to such illustrated and described embodiments.

Figure 1:
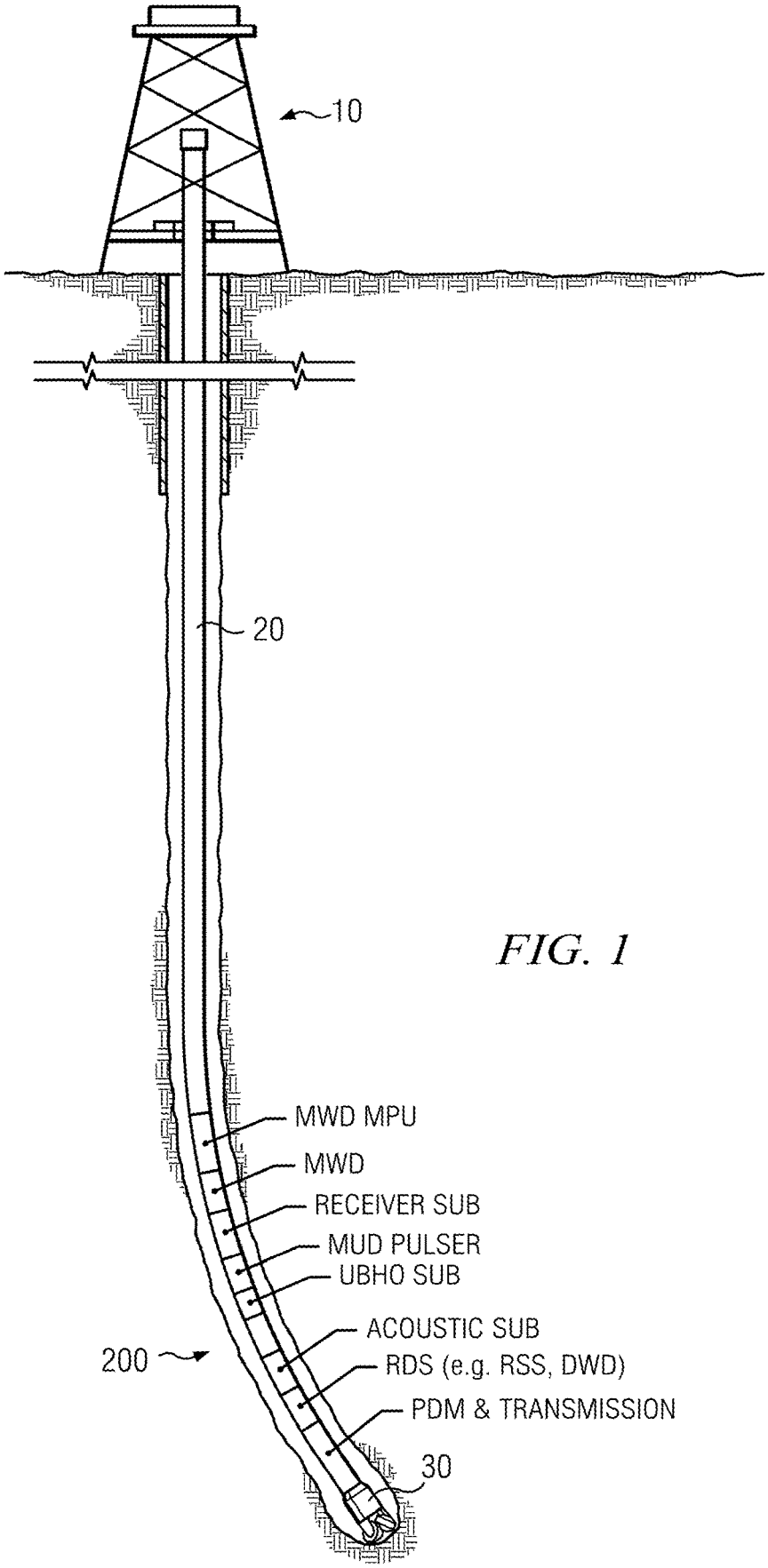
FIG. 1 is a block drawing illustrating schematically a general arrangement of components discussed in this disclosure.

FIG. 1 is a block drawing illustrating schematically a general arrangement of components discussed in this disclosure. FIG. 1 is intended to orient the reader to a typical drillstring arrangement of components illustrated in more detail on FIGS. 3 through 7. FIG. 1 illustrates drilling operations from rig 10, to which bit 30 is connected via drillstring 20. The embodiment of FIG. 1 depicts a deviated wellbore in which bit 30 is driven by a positive displacement motor (PDM), or "mud motor". The scope of this disclosure is not limited, however, to drilling operations involving deviated wellbores or PDM deployments.

The embodiment FIG. 1 further illustrates a section of interest 200 in the Bottom Hole Assembly (BHA). FIGURE depicts BHA of interest 200 including, in order from uphole to downhole:

- Measurement-while-drilling main processing unit (MWD MPU)
- MWD tool
- Receiver Sub
- Mud Pulser
- Universal Bottom Hole Orientation (UBHO sub)
- Acoustic Sub
- Remote Data Sources (RDS), e.g. Rotary Steerable System (RSS) or Diagnostics-while-drilling (DWD) tools
- PDM and transmission The foregoing components will be described in more detail below in context of the acoustic short hop technology described herein. This is with the exception of PDM and transmission deployments, which may be conventional. Comparing FIG. 1 to FIG. 3, the "Acoustic Sub" block shown on FIG. 1 will be understood to correspond to a transmitting tool 202 and an acoustic interface including PEC 203 and reactive mass 204, as shown on FIG. 3 and described further below. Further comparing FIG. 1 to FIG. 3, the "Receiver Sub" block shown on FIG. 1 will be understood to correspond to an acoustic sensor 206 and a receiving tool 207, as shown on FIG. 3 and described further below.

Figure 2:
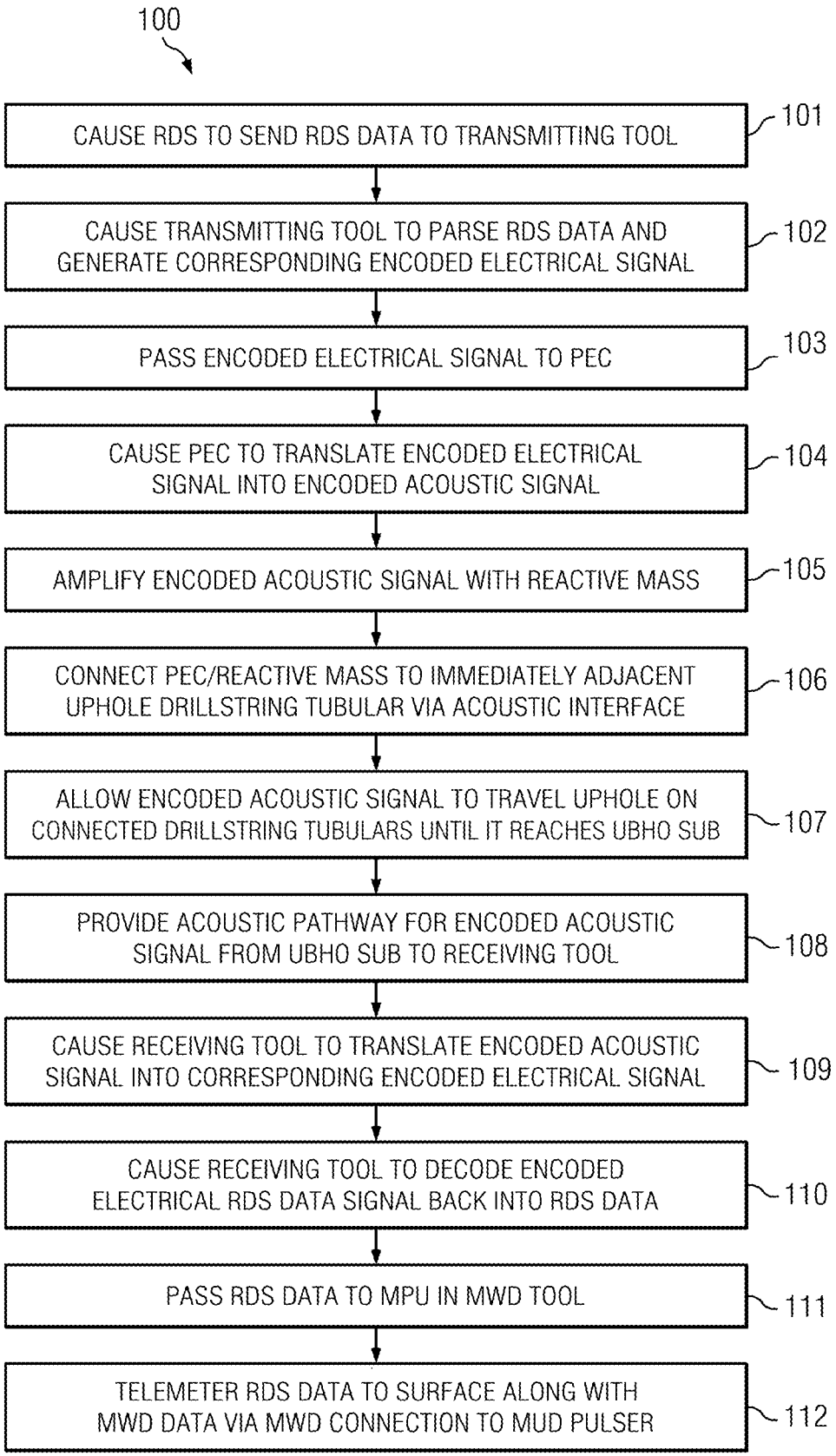
FIG. 2 is a flow chart illustrating method 100, a first method embodiment of the acoustic short hop technology described in this disclosure.
Figure 3:
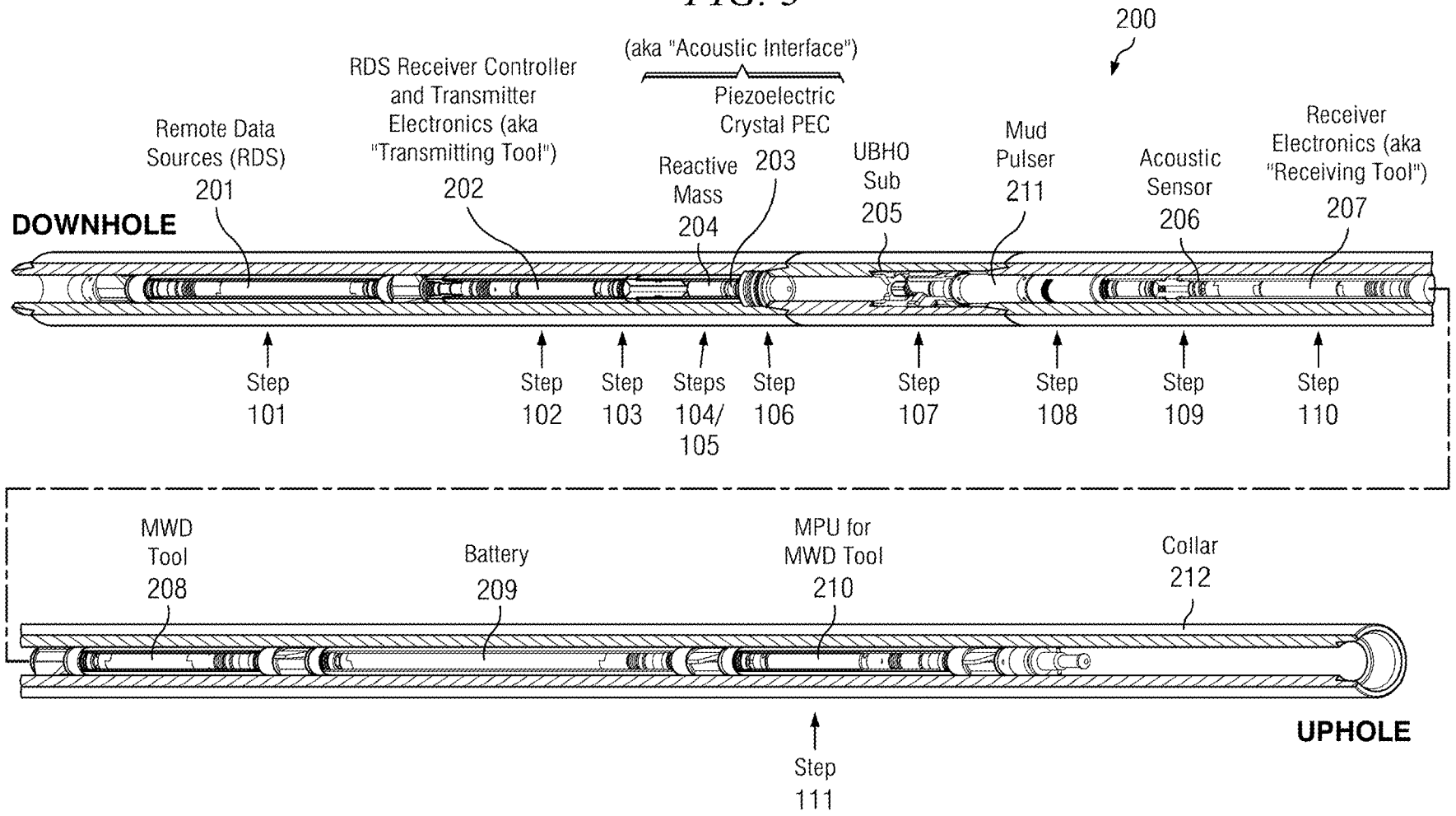
FIG. 3 illustrates an embodiment of BHA section of interest 200 correlated to method 100 on FIG. 2 to show general locations on BHA section of interest 200 where the steps of method 100 are performed.

FIGS. 2 and 3 should now be viewed together. FIG. 2 is a flow chart illustrating method 100. Method 100 represents a first method embodiment of the acoustic short hop technology described in this disclosure. FIG. 3 illustrates an embodiment of BHA section of interest 200 correlated to method 100 on FIG. 2 to show general locations on BHA section of interest 200 where the steps of method 100 are performed.

Step 101 on FIGS. 2 and 3 illustrates sending data from Remote Data Sources (RDS) 201 to receiver controller and transmitter electronics located on board transmitting tool 202. As described earlier in this disclosure, it is operationally advantageous to position certain tools, sensors or other data accumulators close to the bit in order to execute commands to tools located near the bit, or to monitor conditions in that region. RDS 201 may include any such tools, sensors or other data accumulators positioned close to the bit, including (without limitation) Rotary Steerable Systems (RSS), diagnostics-while-drilling (DWD) tools, "smart" motors, and other near-bit sensors. In some embodiments, RDS 201 may be configured to generate RDS data at the RDS itself. In other embodiments, RDS 201 may be configured to generate RDS data from sensors etc. located remote from the RDS itself. RDS 201 may send remote data to transmitting tool 202 via any convenient, conventional connection such as hard wiring or electromagnetic (EM) short hop, for example. A hardwiring option is used in embodiments of RDS 201/transmitting tool 202 illustrated on FIGS. 3 through 7 herein. In some non-illustrated embodiments, transmitting tool 202 may also provide its own RDS sensors located on transmitting tool 202's chassis.

Step 102 on FIGS. 2 and 3 illustrates transmitting tool 202 parsing data received from RDS 201 and generating a corresponding encoded electrical signal. In currently preferred embodiments, transmitting tool 202 uses conventional data encoding techniques to generate an optimized signal into which real-time data from multiple remote data sources are multiplexed. The scope of this disclosure is not limited to encoding or multiplexing techniques used in accumulating data from RDS 201. Further, in some embodiments, encoded electrical data signal generated by transmitting tool 202 may be characterized as a "first encoded RDS data signal" in order to differentiate with Step 109 on FIGS. 2 and 3. As further described below, Step 109 illustrates acoustic sensor 206 translating acoustic signal 104 back into an encoded RDS data signal, which may be characterized herein as a "second encoded RDS data signal." The scope of this disclosure is not limited to the first and second encoded RDS data signals being substantially identical, although in some embodiments they may be substantially identical.

Step 103 on FIGS. 2 and 3 illustrates transmitting tool 202 passing the encoded electrical signal from step 103 to piezoelectric crystal (PEC) 203. In illustrated embodiments, PEC203 is positioned uphole from transmitting tool 202. The scope of this disclosure is not limited in this regard, however, and in other embodiments, PEC 203 may be located downhole from transmitting tool 202. PEC 203 translates the encoded electrical signal to a corresponding acoustic signal (step 104). In currently preferred embodiments, a reactive mass 204 amplifies the acoustic signal generated by PEC 203 (step 105). The scope of this disclosure is not limited, however, to embodiments deploying a reactive mass 204 for amplification purposes. Where deployed, reactive mass 204 is preferably made from a high-density material such as tungsten, although the scope of this disclosure is again not limited in this regard.

Figures 5, 5A:
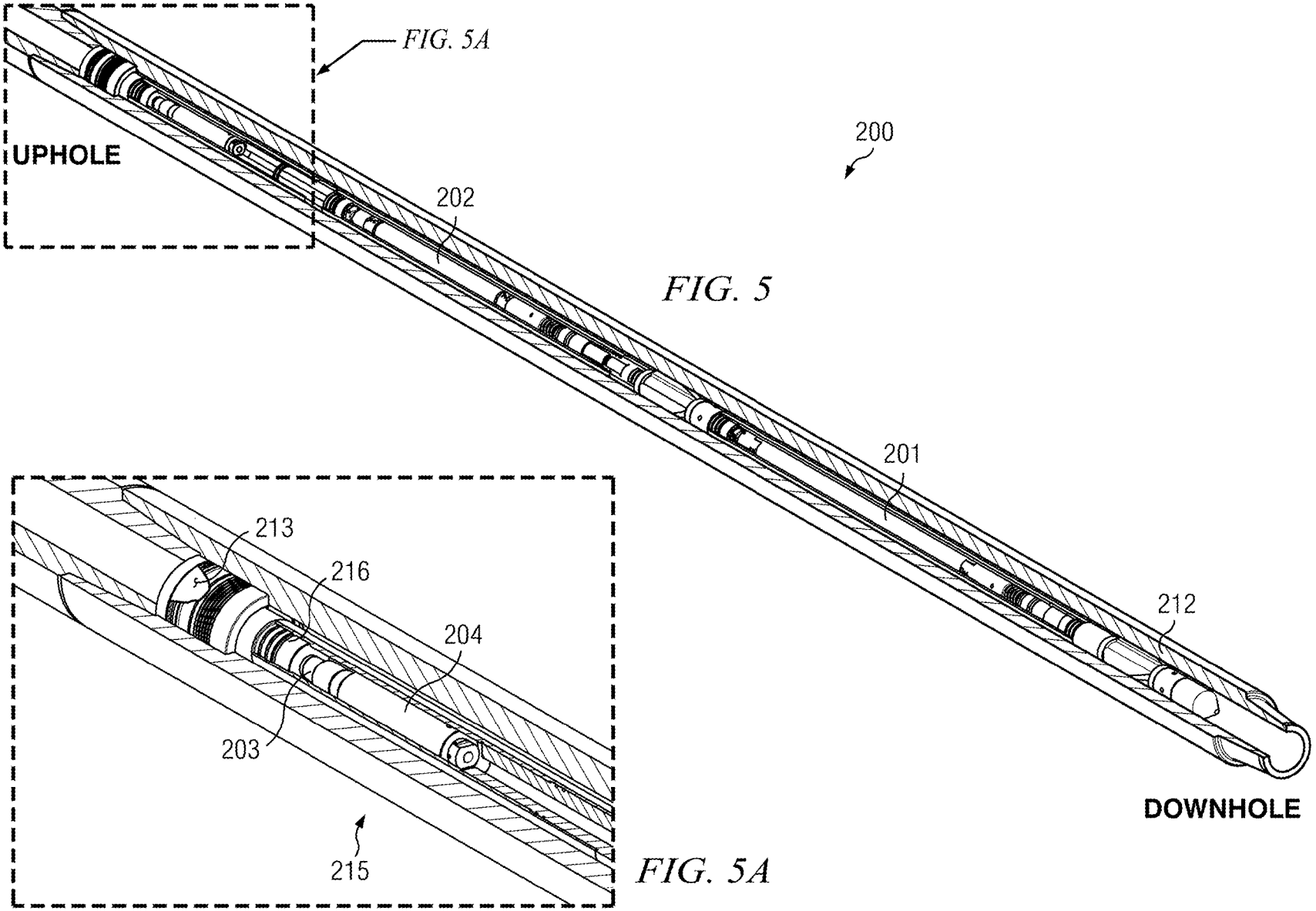
FIG. 5 illustrates a portion of BHA section of interest 200 in which an acoustic signal is generated, in which the acoustic signal represents data from Remote Data Sources (RDS) 201.
FIG. 5A is an enlargement as shown on FIG. 5.

Step 106 on FIGS. 2 and 3 illustrates connecting (acoustically) an acoustic interface including PEC 203 and reactive mass 204 to the immediately uphole drillstring tubular. Acoustic interface 215 is described in more detail below with reference to FIGS. 5 and 5A. Referring momentarily to FIG. 5A, acoustic interface 215 also includes a flat face connection 213 and a compression stack 216 for promoting a strong (unattenuated) acoustic signal connection between acoustic interface 215 and the immediately uphole drillstring tubular. Flat face connection 213 and compression stack 216 are described below in greater detail with reference to FIG. 5A.

Step 107 on FIGS. 2 and 3 illustrates allowing the encoded acoustic signal to travel uphole on connected drillstring tubulars until it reaches Universal Bottom Hole Orientation (UBHO) sub 205. The scope of this disclosure is not limited to the number of drillstring tubulars (or other collared subs or mud motors) that may be in the acoustic signal pathway between acoustic interface 215 and UBHO sub 205 (if any).

Step 108 on FIGS. 2 and 3 illustrates providing an acoustic signal pathway, or "acoustic pathway", from UBHO sub 205 to receiving tool 207. Note that although step 108 on FIG. 2 refers to an acoustic pathway from UBHO sub 205 to receiving tool 207, it will be understood with momentary reference to FIG. 3 that the acoustic pathway more precisely terminates at acoustic sensor 206. Acoustic sensor 206 then translates the received encoded acoustic signal into a corresponding encoded electrical signal and passes same to the receiver electronics located on board receiving tool 207 (step 109). As noted above, this encoded electrical signal translated by acoustic sensor 206 may be characterized as a "second encoded RDS data signal", as differentiated from a first encoded RDS data signal generated by transmitting tool 202 with reference to Step 102. The scope of this disclosure is not limited to the first and second encoded RDS data signals being substantially identical, although in some embodiments they may be substantially identical.

The acoustic pathway disclosed on step 108 through UBHO sub 205 is described below in more detail with reference to FIG. 6A. Referring momentarily to FIG. 6A, embodiments illustrated on FIG. 6A direct acoustic pathway AP through UBHO sub 205 via muleshoe sleeve 217 and muleshoe stinger 218, and then into mud pulser 211. Muleshoe stinger 218 on FIG. 6A provides large seals 219 and small seals 220 for promoting a strong (unattenuated) acoustic signal through muleshoe stinger 218. In alternative embodiments illustrated on FIGS. 8 through 10A, acoustic pathway AP includes acoustic contact assembly sleeve 250 in order to allow the acoustic signal to bypass travel through a shock absorbing tool SAT100 deployed in into alternative BHA section of interest 200A.

Step 110 on FIGS. 2 and 3 illustrates receiving tool 207 decoding the received encoded electrical signal. The decoded signal may be the original RDS data received in step 101, or may be a processed version thereof.

Step 111 on FIGS. 2 and 3 illustrates receiving tool 207 passing the decoded RDS data to MWD MPU 210. Preferably, the connection between receiving tool 207 and MWD MPU 210 for the decoded RDS data is a hardwired connection, although the scope of this disclosure is not limited in this regard.

Step 112 on FIG. 2 illustrates MWD MPU 210 causing the decoded RDS data to be telemetered to the surface by mud pulser 211. Step 112 is not illustrated on FIG. 3 in order promote clarity and to avoid confusion. As described further below with reference to FIG. 7, MWD MPU 210 conventionally causes MWD data received from MWD tool 208 to be telemetered to the surface via mud pulser 211. In accordance with inventive technology described in this disclosure, MWD MPU 210 also causes RDS data to be telemetered to the surface via mud pulser 211 along with MWD data conventionally received.

FIG. 3 also illustrates battery 209 and drill collar 212 for reference in conjunction with other Figures described below.

Figure 4:
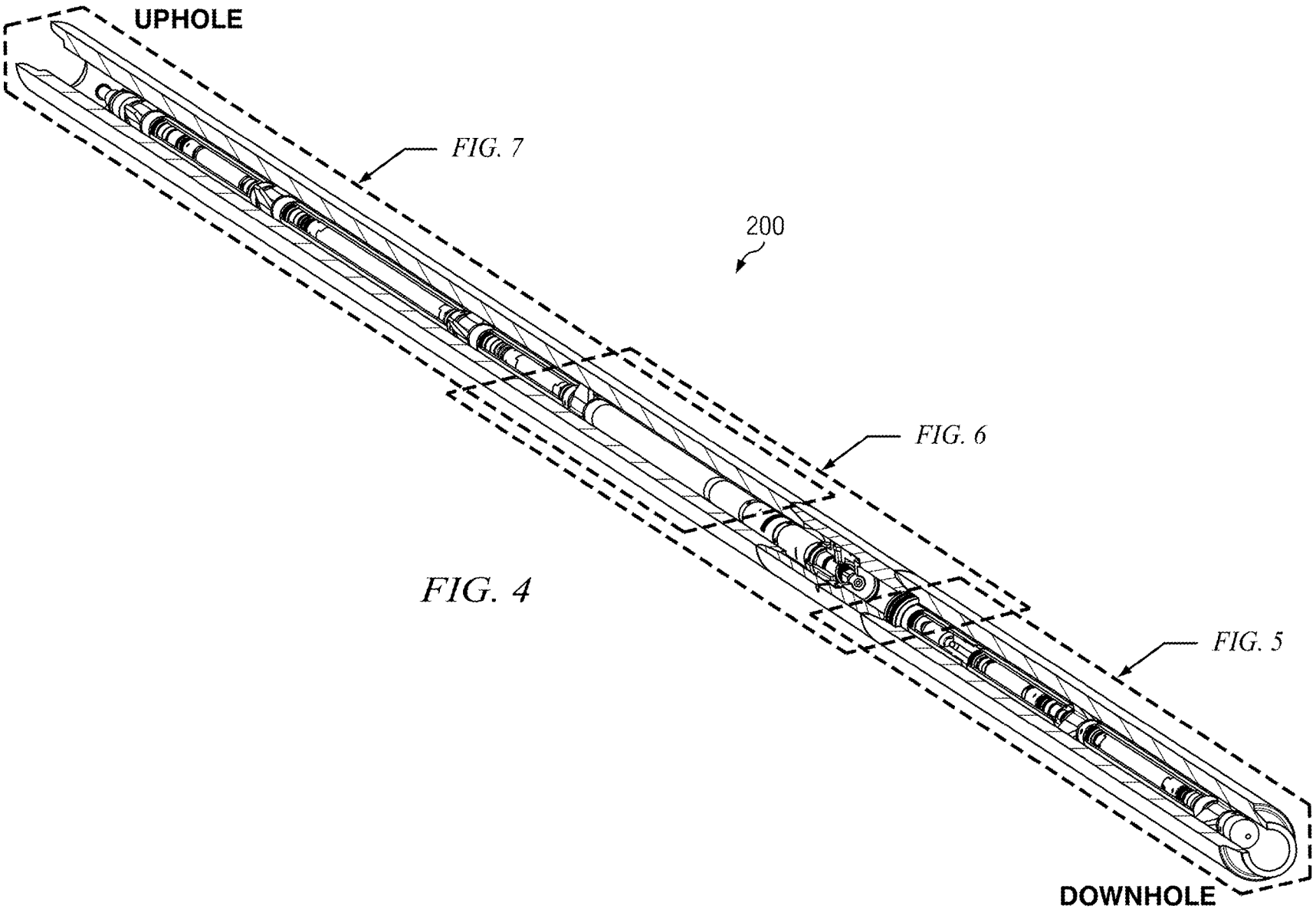
FIG. 4 is a general arrangement drawing of an embodiment of BHA section of interest 200 showing portions thereof illustrated by FIGS. 5, 6 and 7.

FIGS. 4 through 7 should be viewed together. FIG. 4 is a general arrangement drawing of an embodiment of BHA section of interest 200 showing portions thereof illustrated by FIGS. 5, 6 and 7. The boundaries shown on FIG. 4 between FIGS. 5, 6 and 7 have no technical significance. They are for general reference purposes only, intended to promote a better understanding of BHA section of interest 200 as a whole across FIGS. 5, 6 and 7.

FIG. 5 illustrates a portion of BHA section of interest 200 in which an acoustic signal is generated, in which the acoustic signal represents data from Remote Data Sources (RDS) 201.

As described above, RDS 201 on FIG. 5 may include any such tools, sensors or other data accumulators positioned close to the bit, including (without limitation) Rotary Steerable Systems (RSS), diagnostics-while-drilling (DWD) tools, "smart" motors, and other near-bit sensors. FIG. 5 further depicts transmitting tool 202. RDS 201 sends RDS data to receiver electronics located on board transmitting tool 202. Although not specifically illustrated on FIG. 5, non-illustrated embodiments of transmitting tool 202 may provide additional RDS sensors located on transmitting tool 202's chassis. RDS 201 on FIG. 5 sends RDS data to transmitting tool 202 via a hard-wired connection. In other non-illustrated embodiments, RDS 201 may send RDS data to transmitting tool 202 via an electromagnetic (EM) short hop, for example. As also described above with reference to FIGS. 2 and 3, transmitting tool 202 parses RDS data received from RDS 201 and generates a corresponding encoded electrical signal. In currently preferred embodiments, transmitting tool 202 uses conventional data encoding techniques to generate an optimized signal into which real-time data from multiple remote data sources are multiplexed. The scope of this disclosure is not limited to encoding or multiplexing techniques used in accumulating data from RDS 201.

FIG. 5A is an enlargement as shown on FIG. 5, and depicts acoustic interface 215. Acoustic interface 215 on FIG. 5A includes piezoelectric crystal (PEC) 203, reactive mass 204, flat face connection 213 and compression stack 216. As also described above with reference to FIGS. 2 and 3, PEC 203 receives the encoded electrical RDS data signal from transmitting tool 202 and translates same to a corresponding encoded acoustic RDS data signal. It will be understood that PEC 203 will expand in response to current flow. If the current flow oscillates at a given frequency, the PEC will expand and contract at the same frequency, and these movements create vibration that can be encoded with data, creating an encoded acoustic signal.

With further reference to FIG. 5A and as also described above with reference to FIGS. 2 and 3, reactive mass on 204 amplifies the encoded acoustic data signal generated by PEC 203. In some embodiments, reactive mass 204 may also preferentially adjust the natural frequency modes of the transmission. The scope of this disclosure is not limited, however, to embodiments deploying a reactive mass 204. As noted earlier, where deployed, reactive mass 204 is preferably made from a high-density metal such as tungsten, although the scope of this disclosure is again not limited in this regard.

FIG. 5A further illustrates flat face connection 213 and compression stack 216 on acoustic interface 215. It will be appreciated that transmitting tool 202 is probe-based (i.e. located inside collar 212 of the drillstring. Acoustic interface 215 serves as a "bridge" from probe-based components to an acoustic signal pathway on the collar of the drillstring itself. Flat face connection 213 and compression stack 216 combine to promote a strong (unattenuated) acoustic signal connection between acoustic interface 215 and the immediately uphole drillstring tubular. Flat face connection 213 provides strong and tight physical contact over a substantial face area. Compression stack 216 forcefully compresses acoustic interface 215 and the immediately uphole drillstring tubular tightly together at flat face connection 213. As a result, an acoustic signal can pass from acoustic interface 215 to the immediately uphole drillstring tubular without significant loss of signal amplitude. Such a flat face arrangement is in distinction, say, to a threaded connection across which greater acoustic signal attenuation might be expected. Compression stack 216 also allows incremental axial deflections between acoustic interface 215 and the immediately uphole drillstring tubular. In this way, compression stack 216 also corrects for any axial misalignment between acoustic interface 215 and the immediately uphole drillstring tubular, thereby keeping flat face connection 213 tight to reduce potential acoustic signal attenuation.

Figure 6:
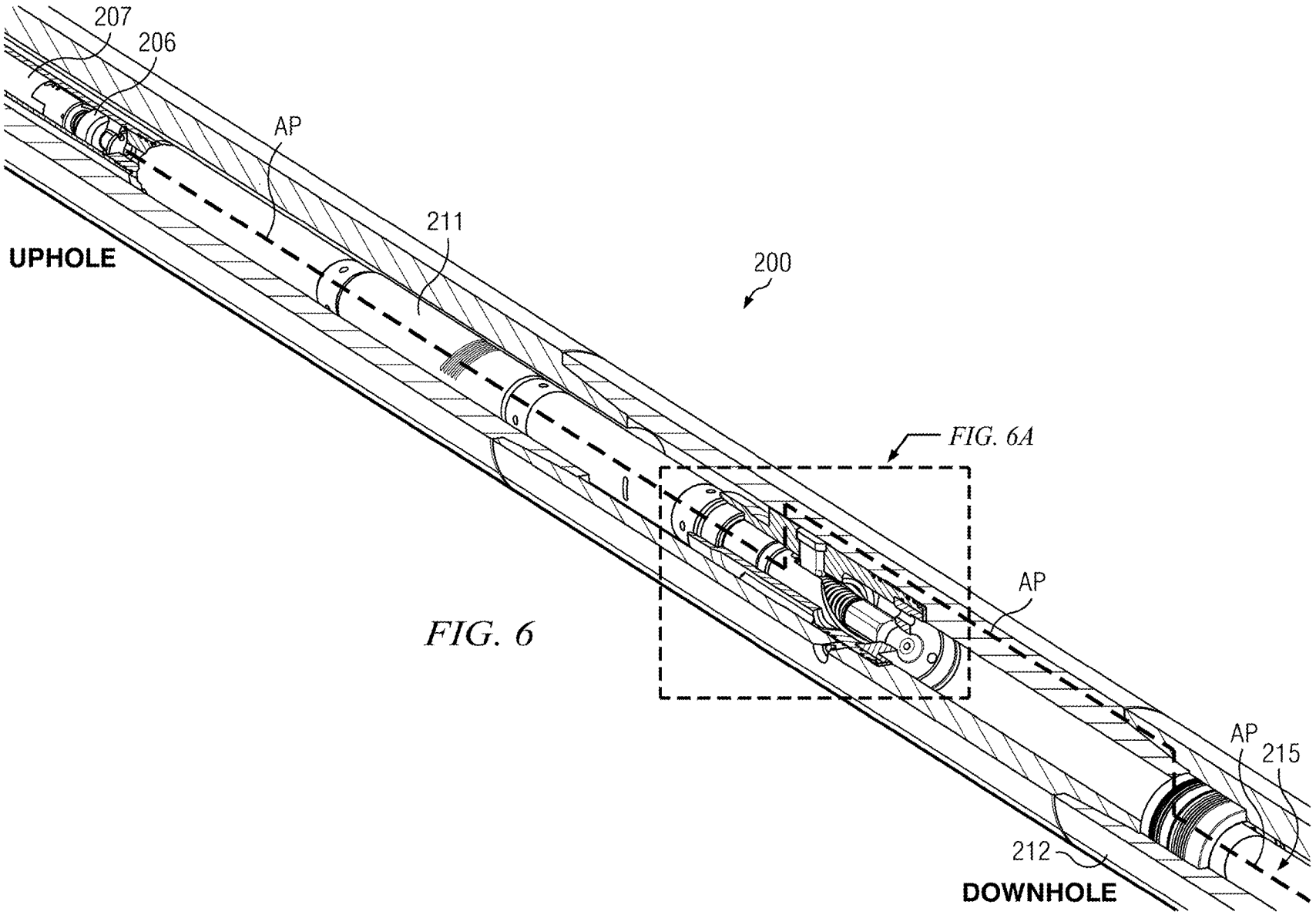
FIG. 6 illustrates a portion of BHA section of interest 200 in which an acoustic signal pathway AP is shown to traverse UBHO sub 205 so that the corresponding acoustic signal may be received by acoustic sensor 206 and receiver electronics 207.
Figure 6A:
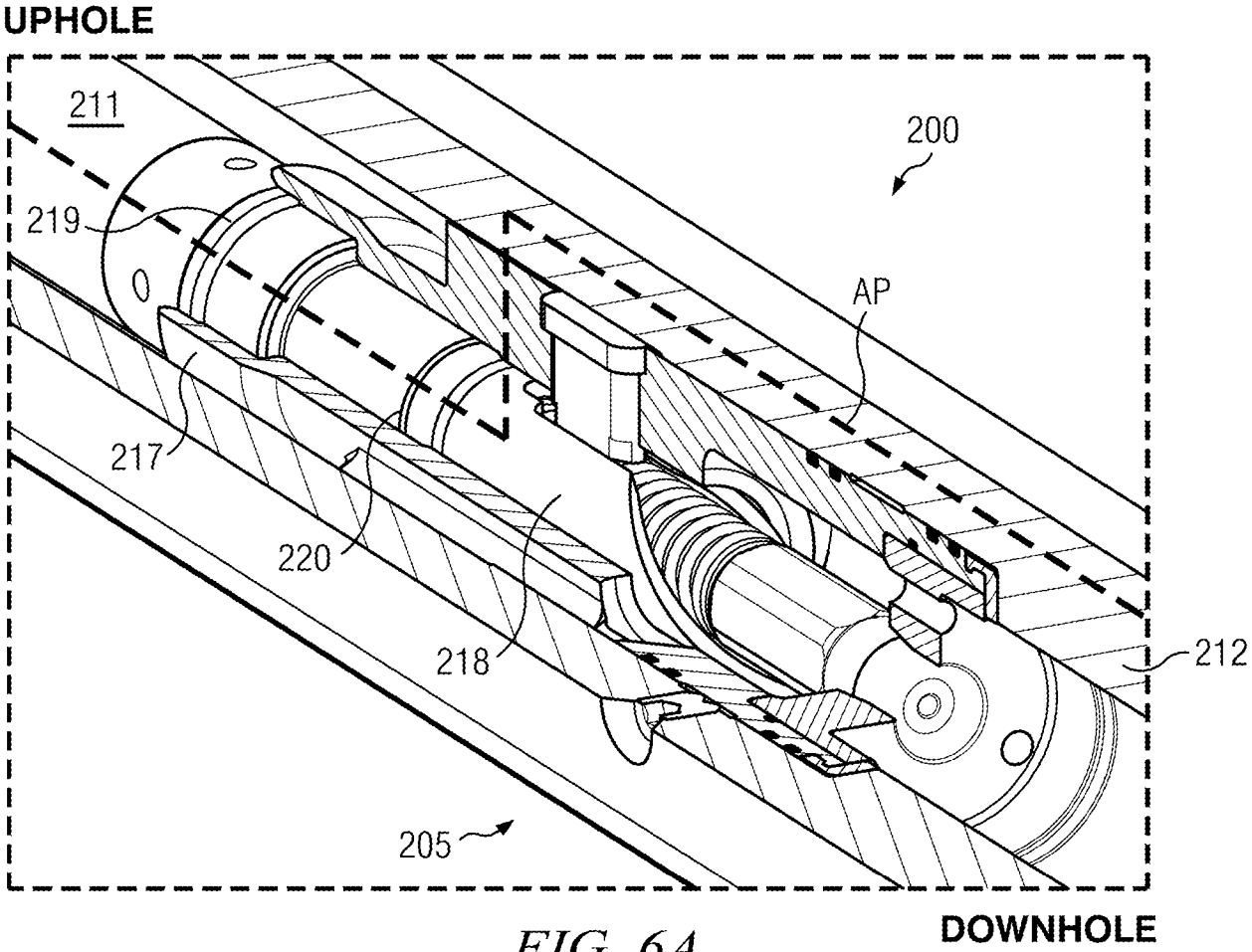
FIG. 6A is an enlargement as shown on FIG. 6.

FIG. 6 illustrates a portion of BHA section of interest 200 in which an acoustic signal pathway AP is established to allow encoded acoustic data signals to travel uphole from acoustic interface 215 to acoustic sensor 206 and receiving tool 207. FIG. 6A is an enlargement as shown on FIG. 6, and depicts acoustic pathway AP traversing UBHO sub 205.

FIG. 6 depicts an initial portion of acoustic pathway AP flowing from acoustic interface 215 to UBHO sub 205. It will be understood from immediately prior description of FIGS. 5 and 5A, that once the encoded acoustic data signal traverses flat face connection 213 on acoustic interface 215, acoustic pathway AP flows uphole until it reaches UBHO sub 205.

Referring now to FIG. 6A, acoustic pathway AP flows through UBHO sub 205 via muleshoe sleeve 217 and muleshoe stinger 218, and then into mud pulser 211. Muleshoe stinger 218 on FIG. 6A further provides large seals 219 and small seals 220 for promoting a strong (unattenuated) acoustic signal through muleshoe stinger 218. Large and small seals 218, 219 provide acoustic insulation to acoustic pathway AP against background acoustic noise, such as shock, vibration and concussion created elsewhere in the drillstring from drilling operations.

Returning now to FIG. 6, a final portion of acoustic pathway AP flows from UBHO sub 205 to acoustic sensor 206 via mud pulser 211. The final portion of acoustic pathway AP may also include other tools or components immediately uphole from mud pulser 211 (note that the scope of this disclosure is indifferent to the presence of any other such tools or components). As shown on FIG. 6, acoustic pathway AP in this final portion is preferably through the casing of mud pulser 211 etc., although it will be understood that acoustic pathway AP may also flow through collar 212 in this portion of drillstring Once acoustic sensor 206 receives the encoded acoustic data signal on acoustic pathway AP, acoustic sensor 206 translates the encoded acoustic signal into a corresponding encoded electrical signal. Acoustic sensor 206 then passes the encoded electrical signal to the receiver electronics located on board receiving tool 207. In currently preferred embodiments, acoustic sensor 206 is an accelerometer, although the scope of this disclosure is not limited in this regard. As noted above with reference to FIGS. 2 and 3, receiving tool 207 decodes the encoded electrical signal received from acoustic sensor 206. The decoded signal may be the original RDS data received from RDS 201 by transmitting tool 202, or may be a processed version thereof.

Figure 7:
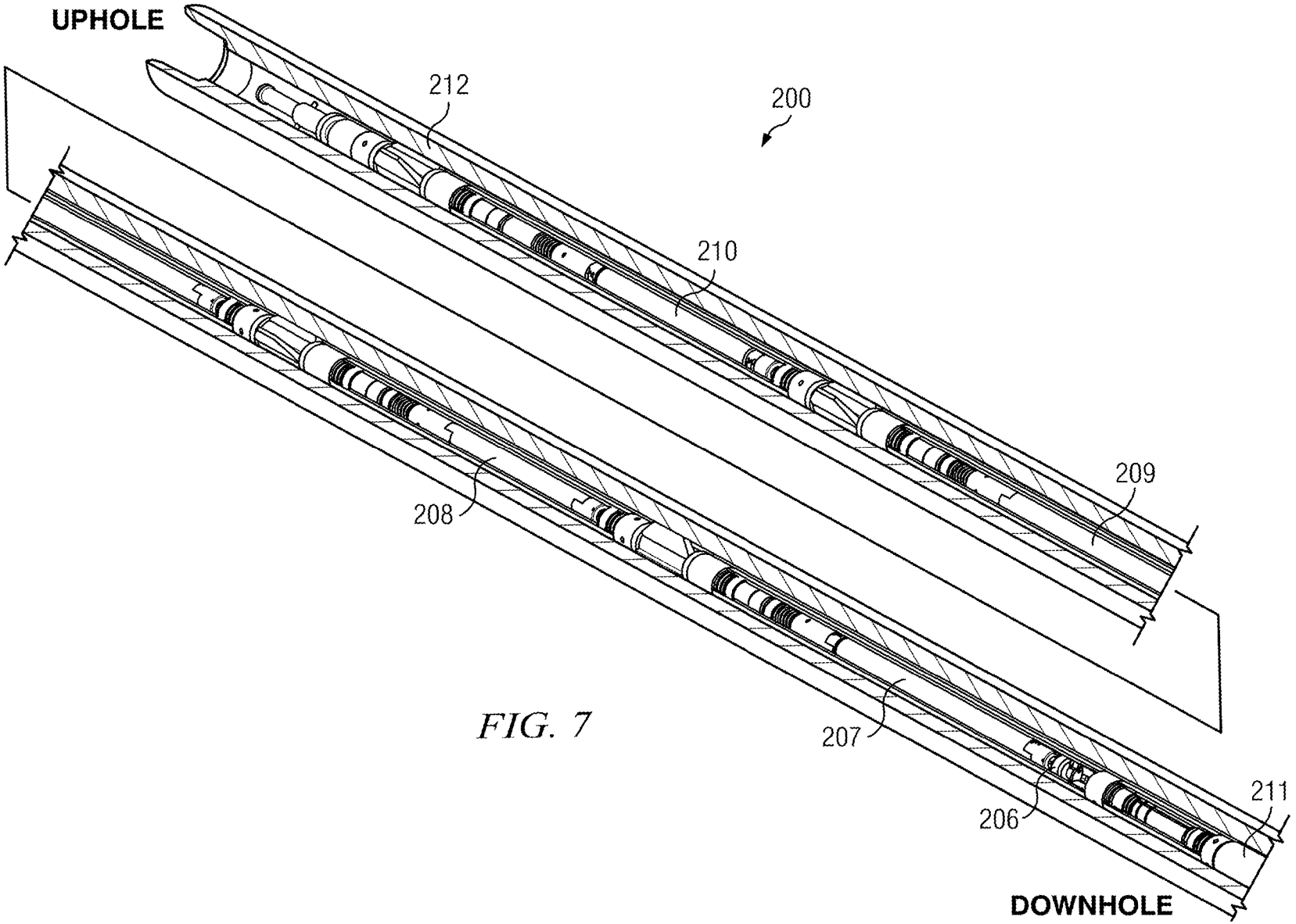
FIG. 7 illustrates a portion of BHA section of interest 200 in which an electrical signal representative of data from RDS 201 may be received by MWD MPU 210 and processed for telemetry to the surface via mud pulser 211.

FIG. 7 illustrates a portion of BHA section of interest 200 in which receiving tool 203 sends the decoded electrical RDS data signal further uphole to MWD MPU 210. Preferably, the data connection between receiving tool 207 and MWD MPU 210 a hardwired connection, although the scope of this disclosure is not limited in this regard.

MWD MPU 210 processes the decoded electrical RDS data signal for telemetry to the surface by mud pulser 211. It will be understood that during conventional MWD operations, MWD MPU 210 receives MWD data generated by MWD tool 208 on FIG. 7. MWD MPU 210 encodes the MWD data signal for mud pulse telemetry, and then passes the encoded MWD data signal downhole to mud pulser 211. Mud pulser 211 telemeters the MWD data to the surface.

According to inventive technology in this disclosure, MWD MPU 210 is configured also to encode the RDS data signal (as received from receiving tool 207) for mud pulse telemetry. MWD MPU 210 may then send the encoded RDS data signal to mud pulser 211 along with encoded MWD data. Mud pulser 211 telemeters the RDS data to the surface.

FIGS. 8 through 10A illustrate alternative embodiments in which the encoded acoustic data signals following acoustic pathway AP is allowed to bypass a shock absorbing tool SAT100 deployed in BHA section of interest 200A. FIG. 8A is an enlargement as shown on FIG. 8.

Figure 8:
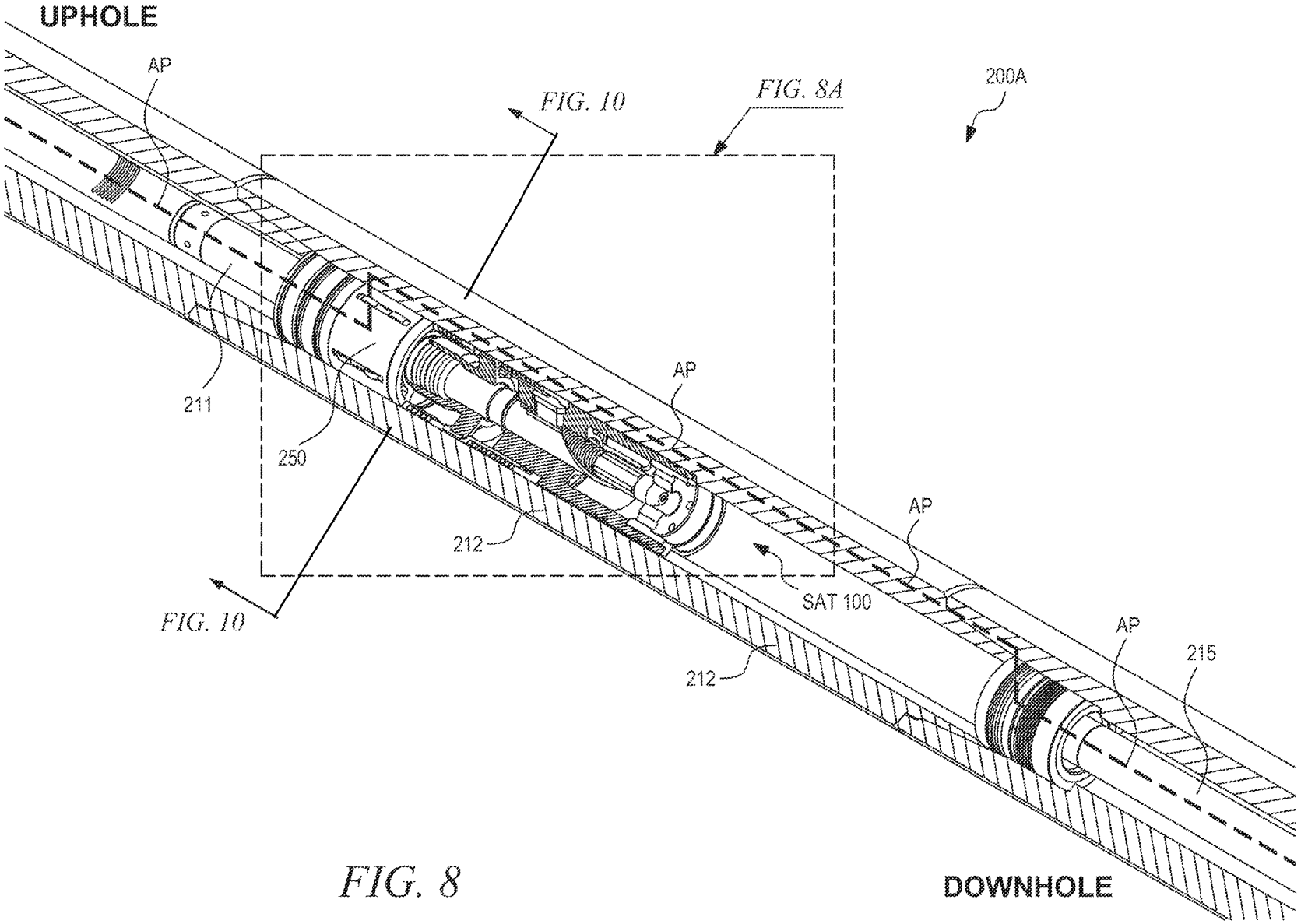
FIG. 8 illustrates an alternative embodiment of a portion of BHA section of interest 200A in which an alternative embodiment of acoustic signal pathway AP is shown to bypass shock absorbing tool SAT100.
Figure 8A:
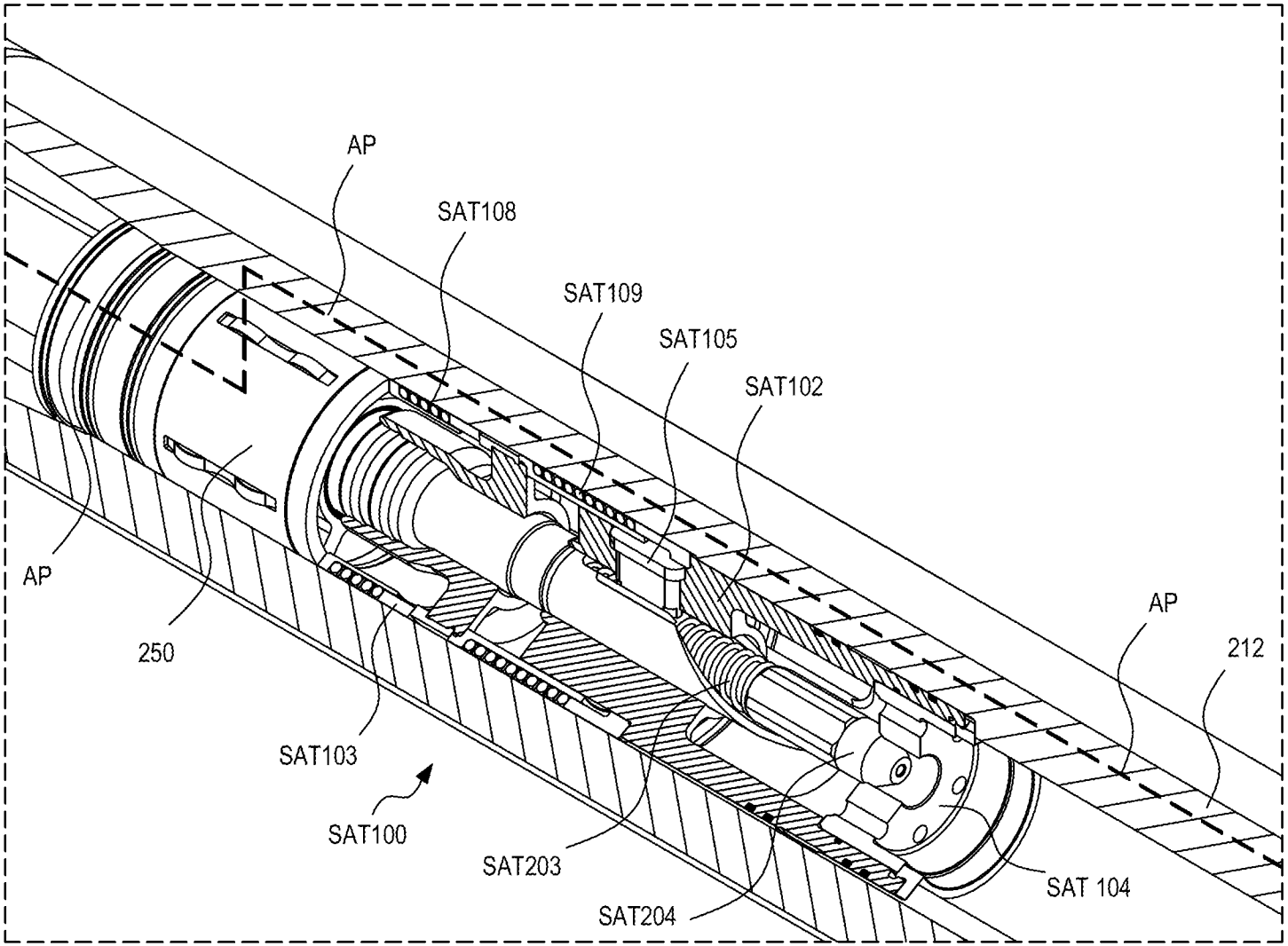
FIG. 8A is an enlargement as shown on FIG. 8.

In more detail, and analogous to FIG. 6, FIG. 8 depicts an alternative embodiment 200A of a portion of BHA section of interest in which, as similarly shown on FIG. 6, an acoustic signal pathway AP is established to allow encoded acoustic data signals to travel uphole from acoustic interface 215 to mud pulser 211 (and then on into acoustic sensor 206 and receiving tool 207, although acoustic sensor 206 and receiving tool 207 are not illustrated on FIG. 8). Different from FIG. 6, however, FIG. 8 has shock absorbing tool SAT100 deployed in BHA section of interest 200A instead of UBHO sub 205 installed in BHA section of interest 200 as shown on FIG. 6. FIG. 8 further shows an alternative embodiment of acoustic signal pathway AP from that depicted on FIG. 6, in which acoustic pathway AP on FIG. 8 runs around shock absorbing tool SAT100, instead of through UBHO sub 205 as shown on FIG. 6. As such, encoded acoustic data signals following acoustic pathway AP on FIG. 8 are allowed, or are able to bypass shock absorbing tool SAT100. BHA section of interest 220A on FIG. 8 includes acoustic contact assembly sleeve 250 (also referred to herein as acoustic contact assembly 250) deployed uphole from shock absorbing tool SAT100. Acoustic pathway AP on FIG. 8 is configured to allow encoded acoustic data signals to travel through acoustic contact assembly 250 in order to bypass travel through shock absorbing tool SAT100.

It will be recalled from earlier description that an advantage provided by a shock absorbing tool SAT100 is to dampen a mud pulser's transmitter valve from environmental vibration or shock forces from drilling operations. As a result, among other benefits, shock absorbing tool SAT100 enables the mud pulser to deliver a cleaner train of acoustic mud pulses in which background environmental acoustic noise has been attenuated. However, as also described above, configuring acoustic pathway AP to travel through SAT100 presents a challenge. Shock absorbing tool SAT100 provides features to dampen the mud pulser's transmitter valve from environmental vibration or shock forces, and so acoustic pathway AP has to avoid these dampening features on the shock absorbing tool SAT100 in order not to inadvertently also dampen and attenuate an acoustic data signal traveling along the acoustic pathway AP. Embodiments illustrated on FIGS. 8 through 10A show acoustic contact assembly 250 provided uphole from shock absorbing tool SAT100, so that encoded acoustic data signals following acoustic pathway AP may travel through acoustic contact assembly 250 in order to bypass travel through shock absorbing tool SAT100.

Shock absorbing tool SAT100 is illustrated on FIG. 8 substantially in the form of the shock absorbing tool embodiments described in U.S. Pat. No. 9,644,434. Components of shock absorbing tool SAT100 use generally the same nomenclature and part numbering on FIGS. 8 and 8A as correspondingly illustrated and described in the '434 patent. Thus, for example, shock sleeve SAT103 on FIG. 8A corresponds to shock sleeve 103 as illustrated and described in the '434 patent. The scope of this disclosure is not limited, however to deployments of the shock absorbing tool embodiments described in the '434 patent. It will be appreciated that alternative shock absorbing tool designs may be substituted into BHA section of interest 200A on FIG. 8 as SAT100, such that acoustic pathway AP on FIG. 8 remains configured to allow encoded acoustic data signals following acoustic pathway AP to bypass shock absorbing tool SAT100.

FIG. 8A is an enlargement as shown on FIG. 8. FIG. 8A illustrates the following components of shock absorbing tool SAT100: UBHO sleeve SAT102; shock sleeve SAT103; main orifice SAT104; alignment key SAT105; upper and lower shock springs SAT108 and SAT109; valve spring SAT203; and valve tip SAT204. Acoustic pathway AP is shown on FIG. 8A traveling uphole along collar 212, bypassing shock absorbing tool SAT100, and continuing uphole until it reaches acoustic contact assembly 250. As will be described below with reference to FIGS. 9, 10 and 10A, acoustic contact assembly 250 is configured to direct acoustic pathway AP on FIGS. 8 and 8A from drill collar 212 into mud pulser 211. Further uphole travel of acoustic pathway AP from mud pulser 211 is consistent with earlier-described embodiments with reference to FIGS. 6 and 7 once acoustic contact assembly 250 has directed acoustic pathway AP into mud pulser 211 per FIGS. 8 through 10A.

Figure 9:
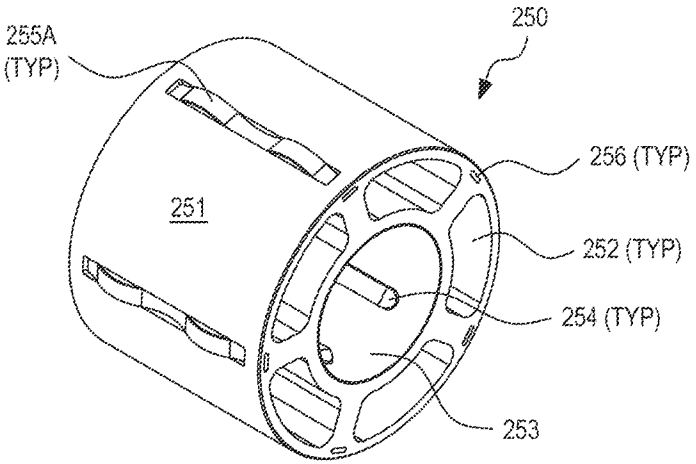
FIG. 9 illustrates acoustic contact assembly sleeve 250 in isolation.
Figure 10A:
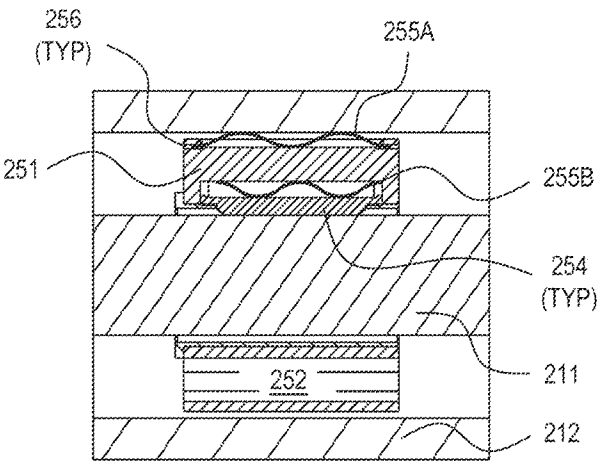
FIG. 10A is a section as shown on FIG. 10.
Figure 10:
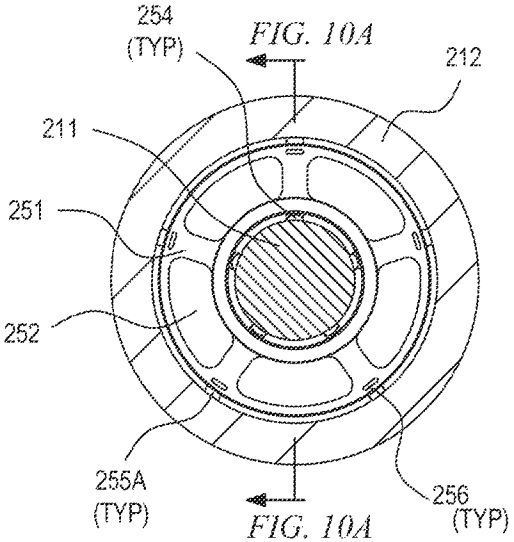
FIG. 10 is a section as shown on FIG. 8.

FIG. 9 illustrates acoustic contact assembly 250 in isolation. FIG. 10 is a section as shown on FIG. 8 and FIG. 10A is a section as shown on FIG. 10. FIGS. 9, 10 and 10A should be viewed together. Acoustic contact assembly 250 includes acoustic contact housing 251. Acoustic contact housing provides annular ports 252 to allow flow of drilling fluid through acoustic contact assembly 250 when acoustic contact assembly 250 is deployed in BHA section of interest 200A as illustrated on FIGS. 8 and 8A.

FIGS. 9, 10 and 10A also show central bore 253 formed into acoustic contact housing 251. Central bore 253 has a diameter selected to receive mud pulser 211 as depicted on FIGS. 10 and 10A with a serviceable clearance fit for acoustic pathway contact as described below. FIGS. 9, 10 and 10A further show acoustic contact housing 251 having an external diameter selected to be received into drill collar 212 with a serviceable clearance fit for acoustic pathway contact as described below.

Continuing with FIGS. 9, 10 and 10A, and with momentary reference to FIGS. 8 and 8A, acoustic contact assembly 250 enables acoustic pathway AP to travel from drill collar 212 to mud pulser 211 via external and internal contact elements 255A, 255B. In the case of internal contact elements 255B, acoustic contact assembly 250 further provides internal acoustic contact bars 254 to enable acoustic pathway AP to travel from acoustic contact housing 251 to mud pulser 211. In embodiments illustrated on FIGS. 9, 10 and 10A, external and internal contact elements 255A, 255B are advantageously metal bands held in longitudinal compression to enable lateral spring bias. The scope of this disclosure is not limited in this regard, however, and it will be appreciated that alternative designs and mechanisms may be deployed for enabling serviceable acoustic pathway contact between drill collar 212 and acoustic contact housing 251, and between acoustic contact housing 251 and mud pulser 211. It will be seen on FIGS. 9 and 10A that external contact elements 255A are received into external recesses formed into an external periphery surface of acoustic contact housing 251, and are held in longitudinal compression by opposing retaining slots 256 provided at either end of the external recesses. Insertion of acoustic contact assembly 250 into drill collar 212 causes an internal surface of drill collar 212 to compress external contact elements 255A laterally, thereby promoting serviceable acoustic pathway contact from drill collar 212 through to acoustic contact housing 251. It will be further seen on FIGS. 9 and 10A that internal contact elements 255B are received into internal recesses formed into central bore 253, and are held in longitudinal compression by internal acoustic contact bars 254 also received into the internal recesses. Internal contact bars 254 also act to compress internal contact elements 255B laterally, thereby promoting serviceable acoustic pathway contact from acoustic contact housing 251 through to mud pulser 211 when mud pulser 211 is received into central bore 253.

VARIATIONS

1. An acoustic datalink in which there is bi-directional communication (thereby enabling surface personnel to both listen to and command the remote data sources). In such variations, transmitter and receiver components would require transceiver capability.
2. An acoustic datalink having wider application than facilitating RDS data communication with MWD systems located further uphole. The acoustic datalink described generally in this disclosure is not limited to such RDS/MWD+pulser deployments.
3. This disclosure describes an embodiment in with the acoustic sensor and receiving tool are substantially integral with the MWD system+pulser. In other embodiments, the acoustic sensor and receiving tool could be located or mounted elsewhere in the BHA or on the drillstring, internally or externally. Alternatively, the acoustic sensor and receiving tool could be a separate tool or sub.

Although the inventive material in this disclosure has been described in detail along with some of its technical advantages, it will be understood that various changes, substitutions and alternations may be made to the detailed embodiments without departing from the broader spirit and scope of such inventive material. Claimed embodiments follow.

We claim:

1. In a Bottom Hole Assembly (BHA) for subterranean drilling oriented such that downhole is towards a drill bit and uphole is away from the drill bit, a method for telemetering data from a Remote Data Source (RDS), the method comprising steps of:

(a) providing a Bottom Mounted Mud Pulser (BMMP) in the BHA;

(b) providing a Main Processing Unit (MPU) and an acoustic sensor uphole in the BHA from the BMMP;

(c) providing a shock absorbing tool downhole in the BHA from the BMMP and the RDS downhole in the BHA from the shock absorbing tool, wherein the RDS is configured to generate RDS data;

(d) encoding the RDS data into a corresponding first encoded RDS data signal;

(e) translating the first encoded RDS data signal into a corresponding acoustic RDS data signal;

(f) causing the acoustic RDS data signal to follow an acoustic pathway to the acoustic sensor, wherein an acoustic contact assembly sleeve allows the acoustic RDS data signal to bypass the shock absorbing tool as the acoustic RDS data signal follows the acoustic pathway;

(g) causing the acoustic sensor to translate the acoustic RDS data signal into a second encoded RDS data signal;

(h) causing the MPU to decode the second encoded RDS data signal into RDS data and send said decoded RDS data to the BMMP; and (i) causing the BMMP to telemeter RDS data received from the MPU in at least an uphole direction.

2. The method of claim 1, in which selected ones of the MPU and the BMMP are retrievable.

3. The method of claim 1, in which the first and second encoded RDS data signals are substantially the same.

4. The method of claim 1, in which the RDS is configured to generate RDS data at the RDS.

5. The method of claim 1, in which step (e) is performed downhole in the BHA from the RDS.

6. The method of claim 1, in which the RDS is selected from at least one of a group consisting of:

(1) a Diagnostics While Drilling tool;

(2) a Logging While Drilling tool;

(3) a Measurement While Drilling tool;

(4) a Dynamics While Drilling tool;

(5) a Rotary Steerable System; and (6) a smart motor.

7. The method of claim 1, in which the acoustic contact assembly sleeve is deployed uphole in the BHA from the shock absorbing tool.

8. In a Bottom Hole Assembly (BHA) for subterranean drilling oriented such that downhole is towards a drill bit and uphole is away from the drill bit, a method for telemetering data from a Remote Data Source (RDS), the method comprising steps of:

(a) providing a Bottom Mounted Mud Pulser (BMMP) in the BHA;

(b) providing a Main Processing Unit (MPU) and an acoustic sensor uphole in the BHA from the BMMP;

(c) providing a shock absorbing tool downhole in the BHA from the BMMP and the RDS downhole in the BHA from the shock absorbing tool, wherein the RDS is configured to generate RDS data at the RDS;

(d) providing a piezoelectric translator downhole in the BHA from the shock absorbing tool;

(e) encoding the RDS data into a corresponding first encoded RDS data signal;

(f) causing the piezoelectric translator to translate the first encoded RDS data signal into a corresponding acoustic RDS data signal;

(g) causing the acoustic RDS data signal to follow an acoustic pathway to the acoustic sensor, wherein an acoustic contact assembly sleeve allows the acoustic RDS data signal to bypass the shock absorbing tool as the acoustic RDS data signal follows the acoustic pathway;

(h) causing the acoustic sensor to translate the acoustic RDS data signal into a second encoded RDS data signal;

(i) causing the MPU to decode the second encoded RDS data signal into RDS data and send said decoded RDS data to the BMMP; and (j) causing the BMMP to telemeter RDS data received from the MPU, wherein said telemetry by the BMMP is in at least an uphole direction.

9. The method of claim 8, in which selected ones of the MPU and the BMMP are retrievable.

10. The method of claim 8, in which the first and second encoded RDS data signals are substantially the same.

11. The method of claim 8, in which the piezoelectric translator is positioned downhole in the BHA from the RDS.

12. The method of claim 8, in which the RDS is selected from at least one of a group consisting of:

(1) a Diagnostics While Drilling tool;

(2) a Logging While Drilling tool;

(3) a Measurement While Drilling tool;

(4) a Dynamics While Drilling tool;

(5) a Rotary Steerable System; and (6) a smart motor.

13. The method of claim 8, in which the acoustic contact assembly sleeve is deployed uphole in the BHA from the shock absorbing tool.

14. A Bottom Hole Assembly (BHA) for subterranean drilling oriented such that downhole is towards a drill bit and uphole is away from the drill bit, the BHA comprising:

a Bottom Mounted Mud Pulser (BMMP);

a Main Processing Unit (MPU) positioned uphole from the BMMP;

an acoustic sensor positioned uphole from the BMMP;

a shock absorbing tool positioned downhole from the BMMP;

a Remote Data Source (RDS) positioned downhole from the shock absorbing tool, wherein the RDS is configured to generate RDS data;

a piezoelectric translator positioned downhole from the shock absorbing tool, wherein the piezoelectric translator is configured to translate a first encoded RDS data signal into a corresponding acoustic RDS data signal; and an acoustic pathway traveling from the piezoelectric translator to the acoustic sensor;

wherein the acoustic pathway is configured to carry the acoustic RDS data signal to the acoustic sensor, wherein an acoustic contact assembly sleeve allows the acoustic RDS data signal to bypass the shock absorbing tool as the acoustic RDS data signal follows the acoustic pathway;

wherein the acoustic sensor is configured to translate the acoustic RDS data signal into a second encoded RDS data signal;

wherein the MPU is configured to decode the second encoded RDS data signal into RDS data and send said decoded RDS data to the BMMP; and wherein the BMMP is configured to telemeter RDS data received from the MPU in at least an uphole direction.

15. The BHA of claim 14, in which selected ones of the MPU and the BMMP are retrievable.

16. The BHA of claim 14, in which the first and second encoded RDS data signals are substantially the same.

17. The BHA of claim 14, in which the piezoelectric translator is positioned downhole from the RDS.

18. The BHA of claim 14, in which the RDS is configured to generate RDS data at the RDS.

19. The BHA of claim 14, in which the RDS is selected from at least one of a group consisting of:

(1) a Diagnostics While Drilling tool;

(2) a Logging While Drilling tool;

(3) a Measurement While Drilling tool;

(4) a Dynamics While Drilling tool;

(5) a Rotary Steerable System; and (6) a smart motor.

20. The BHA of claim 14, in which the acoustic contact assembly sleeve is deployed uphole from the shock absorbing tool.

* * * * *